United States Patent [19]

Rockola

[11] Patent Number: 4,913,313

[45] Date of Patent: Apr. 3, 1990

[54] DUAL SERPENTINE TRACK MAGAZINE FOR COIN OPERATED CAN VENDORS

[75] Inventor: Donald C. Rockola, Chicago, Ill.

[73] Assignee: Rock-Ola Manufacturing Corporation, Addison, Ill.

[21] Appl. No.: 245,451

[22] Filed: Sep. 16, 1988

[51] Int. Cl.[4] ..... G07F 11/34

[52] U.S. Cl. ..... 221/131; 221/281; 312/45

[58] Field of Search ..... 221/14, 17, 108, 109, 221/111, 116, 129, 131, 242, 281, 295; 312/45, 72; 211/49.1, 59.2

[56] References Cited

U.S. PATENT DOCUMENTS

| | | | |
|---|---|---|---|
| 3,348,733 | 10/1967 | Johnson | 221/242 X |
| 3,498,497 | 3/1970 | Baxendale et al. | 221/116 |
| 3,613,945 | 10/1971 | Rockola | 221/295 |
| 3,628,643 | 12/1971 | Bookout | 221/14 X |
| 3,938,700 | 2/1976 | Camp et al. | 221/109 |
| 4,347,952 | 9/1982 | Bookout | 312/45 |
| 4,485,937 | 12/1984 | Adams | 221/129 |

FOREIGN PATENT DOCUMENTS

| | | | |
|---|---|---|---|
| 53-37095 | 3/1977 | Japan | 221/131 |
| 789281 | 1/1958 | United Kingdom | 211/59.2 |

*Primary Examiner*—F. J. Bartuska

*Attorney, Agent, or Firm*—McCaleb, Lucas & Brugman

[57] ABSTRACT

A magazine having multiple columns for storing cylindrical articles, such as canned beverages, in a coin operated vending machine. The magazine is fabricated preferably of sheet metal to include a plurality of vertical planar wall members held in parallel spaced relation by intervening transverse spacers and connector rods forming a plurality of vertical article storage columns therebetween. Opposing faces of each of two adjacent wall members are provided with a pair of laterally spaced non-overlapping serpentine rail assemblies. Opposing pairs of such rail assemblies between adjacent wall members are registeringly aligned to form two non-overlapping serpentine tracks which are designed to support cylindrical articles, such as beverage cans and the like. Each such serpentine track gravitationally feeds articles to an independently operable vending mechanism located at its lower end and each such track is equipped with a novel article stop mechanism capable, when actuated, to isolate the vending mechanism from the weight of the canned articles in an overdisposed serpentine track. Each of the rail assemblies in a storage column is fabricated from a plurality of curvelinear and straight rail segments, the individual segments being unified into a serpentine configuration by attachment to one face of a supporting wall member. The rails so fabricated on opposite sides or faces of the same wall member are registeringly aligned back-to-back with the correspondingly aligned segments thereof joined to the intervening wall member, preferably at common attachment points.

10 Claims, 5 Drawing Sheets

FIG. 1
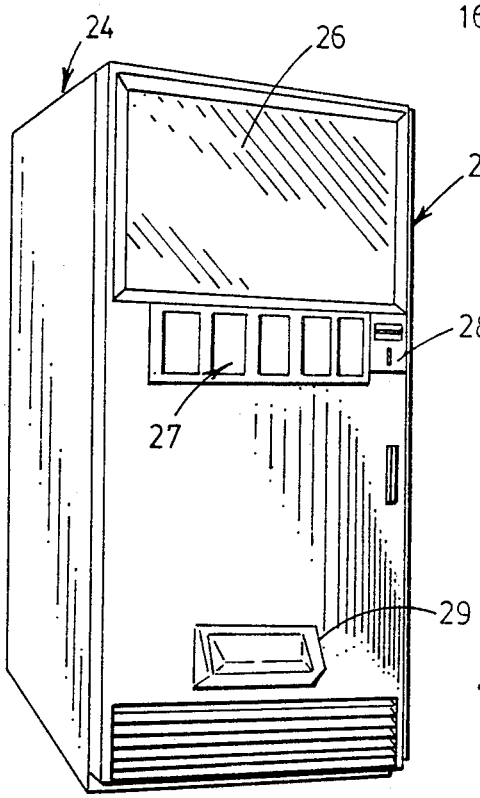
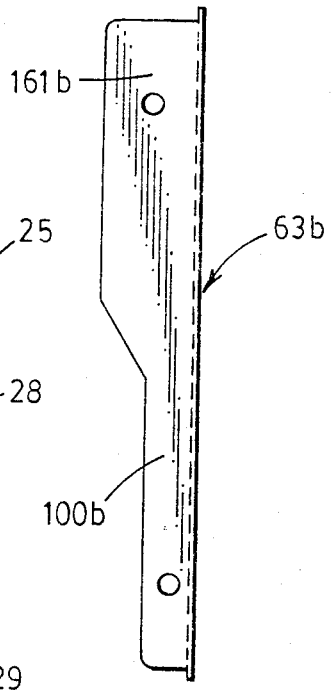
FIG. 15
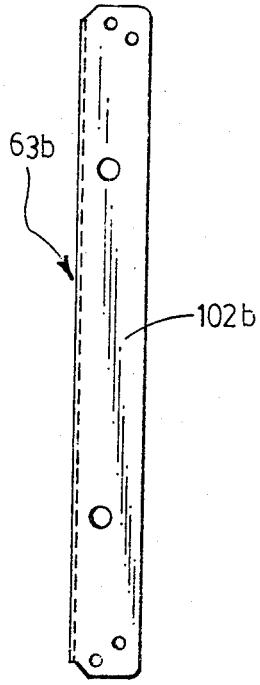
FIG. 16
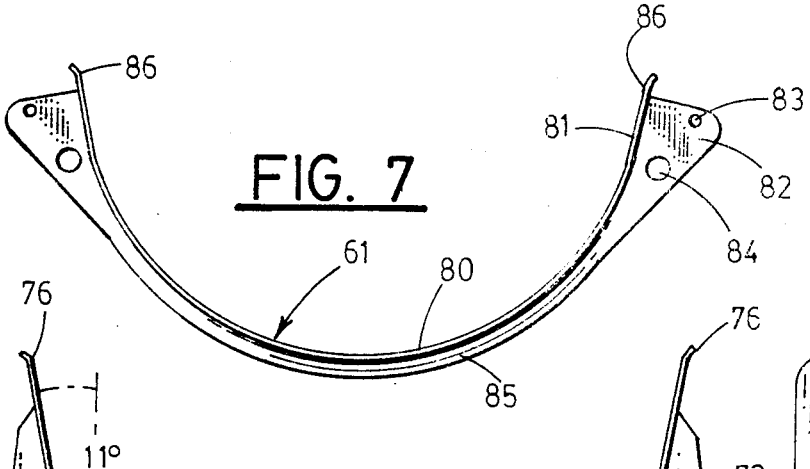
FIG. 7
FIG. 8
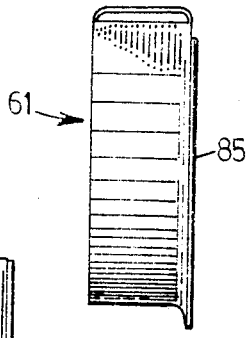
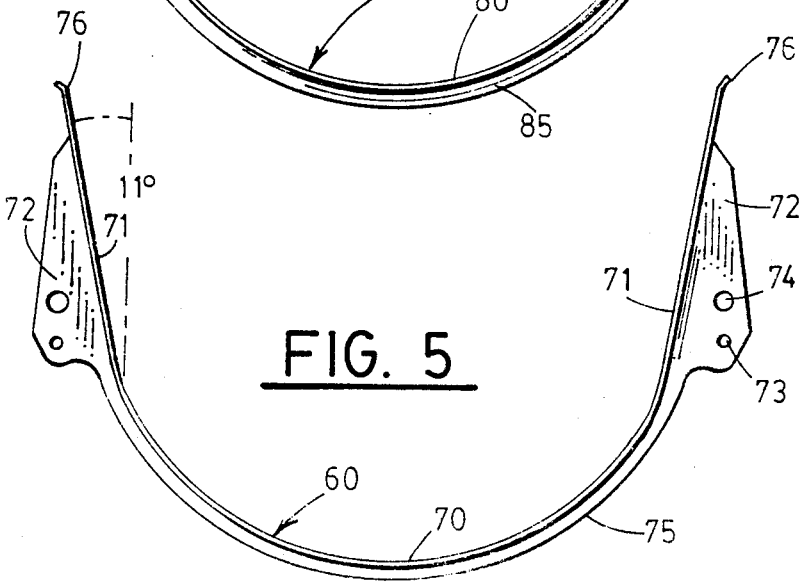
FIG. 5
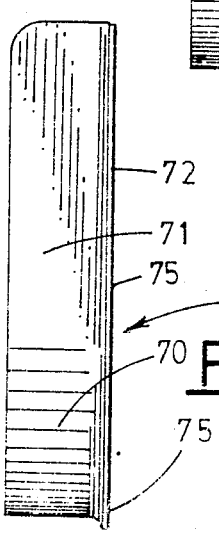
FIG. 6

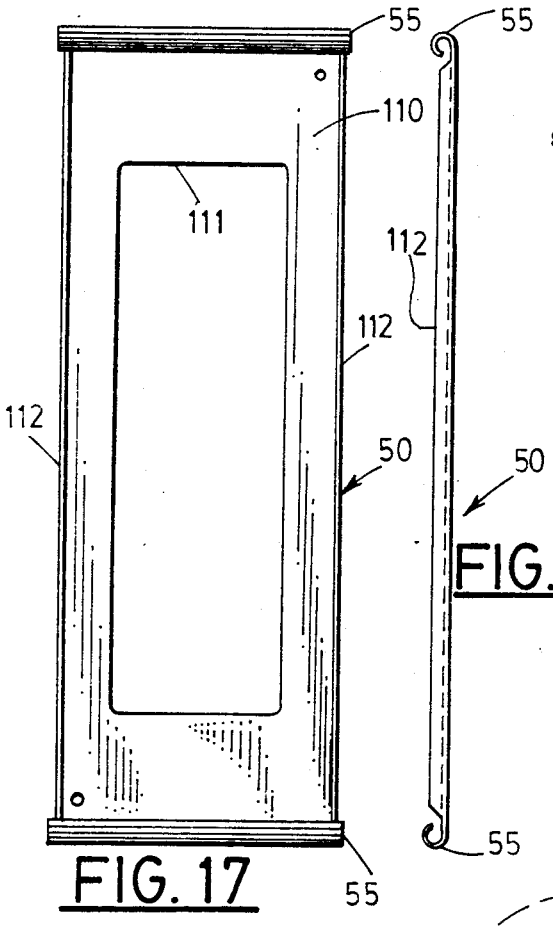
FIG. 17
FIG. 18
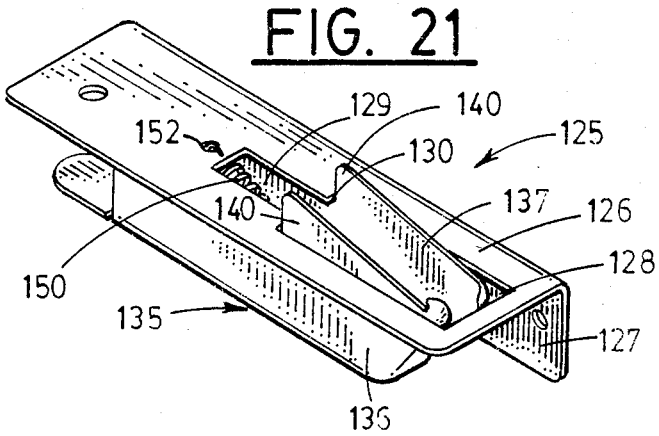
FIG. 21
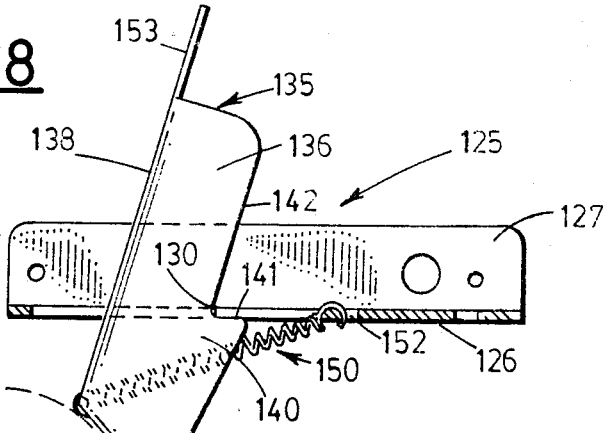
FIG. 22
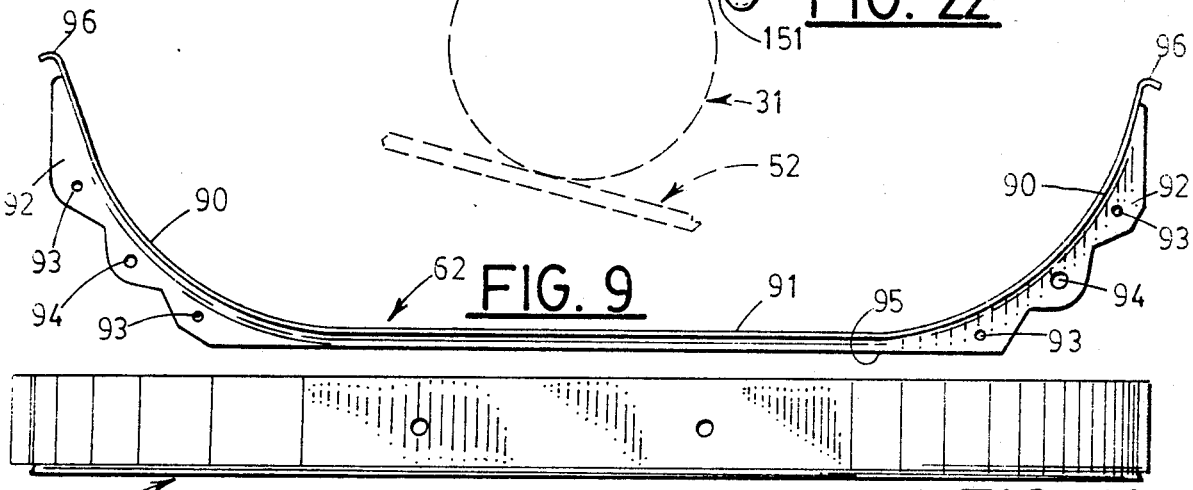
FIG. 9
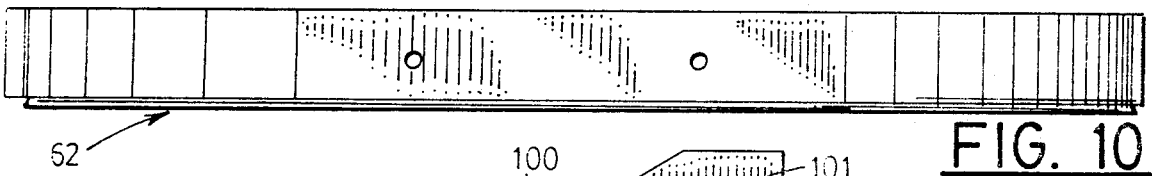
FIG. 10
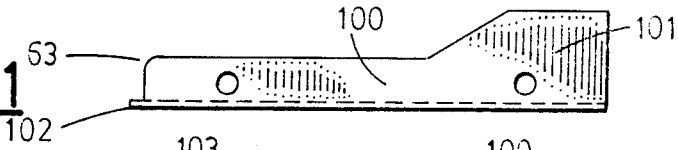
FIG. 11
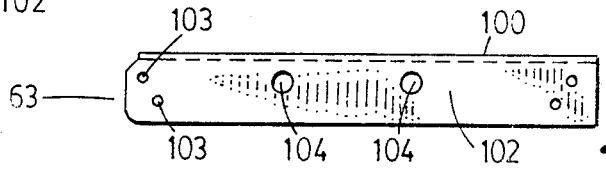
FIG. 12

FIG. 19
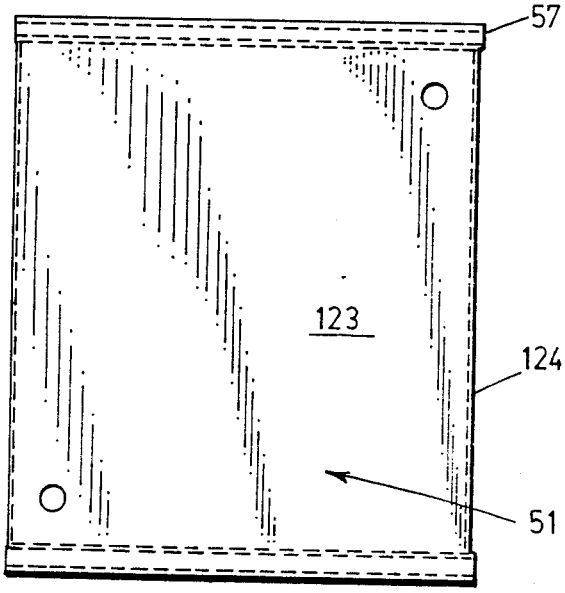
FIG. 20
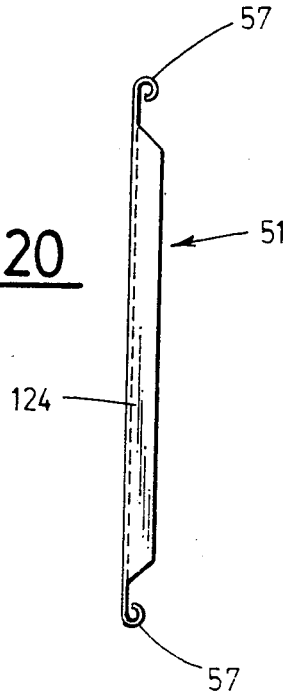
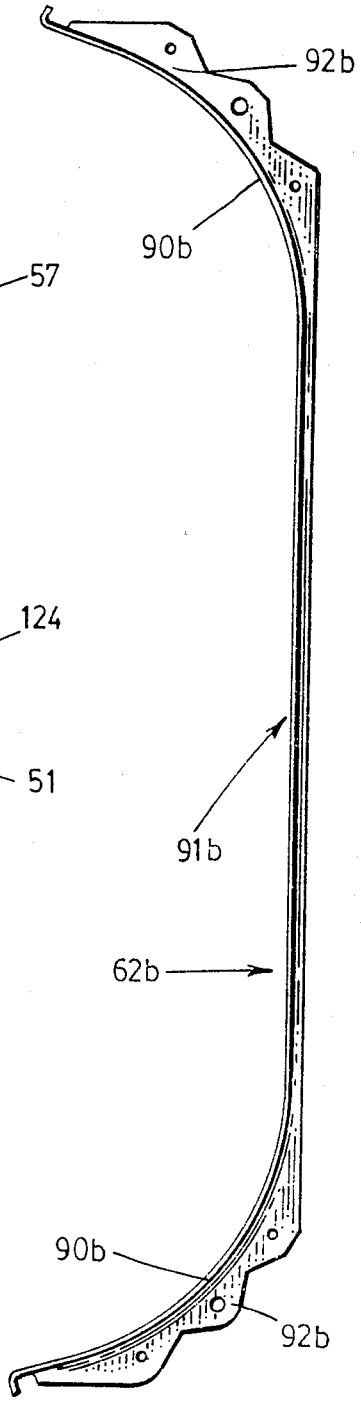
FIG. 13
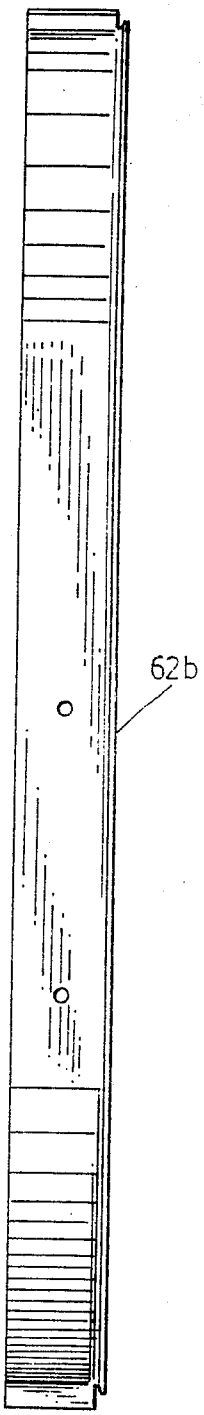
FIG. 14

DUAL SERPENTINE TRACK MAGAZINE FOR COIN OPERATED CAN VENDORS

This invention relates to automatic coin-operated vending machines, and more particularly to improvements in multiple column magazines employed therein for storing a plurality of cylindrical articles, such as canned beverages and the like.

BACKGROUND OF THE INVENTION

Storage capacity of a can vending machine can be increased by altering the dimensions of the machine cabinet to provide additional interior volume for accommodating larger storage magazines. However, the dimensions of a can vending machine cabinet have practical limits, depending on space limitations and constraints at the point of utilization. Additionally, there is a constant vying for can vending machines which will dispense a larger and wider variety of beverage flavors and types such as juice and carbonated beverages. Thus, there has been and continues to be concentrated effort toward more effective storage magazines in can vending machines.

Prior to this invention, single serpentine track magazines were known as taught in U.S. Pat. No. 3,613,945 issued Oct. 19, 1971, for instance. According to the teachings of that patent a continuous serpentine track is provided along which the canned articles gravitationally roll from the upper end of the magazine to a discharge station at the lower end thereof.

Double serpentine track magazines also have been developed. In one such structure a pair of serpentine tracks are folded one within the other and composed of three opposing sets of track rails projecting from opposing faces of parallel spaced magazine walls so that the intermediate or middle rail thereof is common to both serpentine tracks. Typifying this structure are the teachings of U.S. Pat. No. 3,498,497 issued March 3, 1970.

An improvement over the three rail dual serpentine track arrangement of U.S. Pat. No. 3,498,497 is set forth in U.S. Pat. No. 4,347,952 issued Sep. 7, 1982, to the assignee hereof. The teachings of this patent constitute a marked improvement in efficient utilization of the interior cabinet space, increased storage capacity and improved operational characteristics over the prior art. In particular, this later patent advanced the art by providing a pair of non-overlapping serpentine tracks in a vertical magazine column such that the pair of tracks were separated in front to back spaced relationship affording front end loading and increased article storage capacity.

The present invention is particularly concerned with a dual serpentine track magazine having the general characteristics set out in the aforesaid U.S. Pat. No. 4,347,952, but distinguished thereover by virtue of improved structural arrangement of parts leading to economies of production and more efficient utilization of the interior volume of a vending machine cabinet.

It is a principle object of this invention to provide a dual serpentine track magazine for utilization in automatic coin-operated can vending machines which provides increased storage capacity and more efficient utilization of interior cabinet space.

Another important object of this invention is to provide a dual serpentine track magazine, as aforesaid, in which a pair of like serpentine article carrying tracks are disposed in spaced front-to-back relationship, one behind the other, between a pair of parallel spaced wall members on which are mounted a plurality of serpentine rails.

Still another important object of this invention is provided a serpentine track magazine, particularly useful in can vending machines, which is front loading with respect to plural serpentine tracks of a magazine column and in which each column has its own independent vending mechanism for controlling the discharge of articles one by one from the lower ends thereof in accordance with customer article selection.

Still another important object of this invention is to provide a new and improved dual serpentine track magazine for can vending machines which is characterized by its simplicity of construction and utilization of a plurality of uniform parts to fabricate serpentine tracks leading to marked manufacturing economies.

The above and further objects, features and advantages of this invention will be recognized by those familiar with the art from the following detailed description of a preferred embodiment thereof, illustrated in the accompanying drawings and representing the best mode presently contemplated for enabling those of skill in the art to practice this invention.

IN THE DRAWINGS:

FIG. 1 is a perspective view of a typical can vending machine of the order to which the present invention is applicable;

FIG. 5 is a front elevation of a principle curvelinear rail element employed in the magazine structure shown in FIG. 2;

FIG. 6 is a side elevation of the rail element illustrated in FIG. 5;

FIG. 7 is a front elevation of a second curvelinear rail element employed in the magazine structure illustrated in FIG. 2;

FIG. 8 is a side elevation of the rail element shown in FIG. 7;

FIG. 9 is a front elevation of a combination straight and curvelinear rail element employed in the magazine structure illustrated in FIG. 2;

FIG. 10 is a side elevational view of the rail element illustrated in FIG. 9;

FIG. 11 is a front elevational view of a short straight rail element employed in the magazine structure of FIG. 2;

FIG. 12 is a side elevation of the rail element shown in FIG. 11;

FIG. 13 is a front elevational view of a second combination curvelinear and straight rail element employed in the magazine structure of FIG. 2;

FIG. 14 is a side elevational view of the rail element shown in FIG. 13;

FIG. 15 is a front elevational view of a long linear rail element employed in the magazine structure shown in FIG. 2;

FIG. 16 is a side elevational view of the rail element shown in FIG. 15;

FIG. 17 is a front elevational view of a loading and discharge platform element utilized in the magazine structure shown in FIG. 2;

FIG. 18 is a side elevational view of the platform element shown in FIG. 17;

FIG. 19 is a front elevational view of a second platform element utilized in the magazine structure of FIG. 2;

FIG. 20 is a side elevation of the platform element shown in FIG. 19;

FIG. 21 is a perspective view of a can stop mechanism employed in the magazine structure of FIG. 2 showing the same in an upside-down position to better illustrate the arrangement of parts thereof; and FIG. 22 is a side elevational view of the can stop mechanism of FIG. 21 showing the same in operating position with a cylindrical article indicated in dotted lines in that figure.

DESCRIPTION OF THE PREFERRED EMBODIMENT

Figure 2:
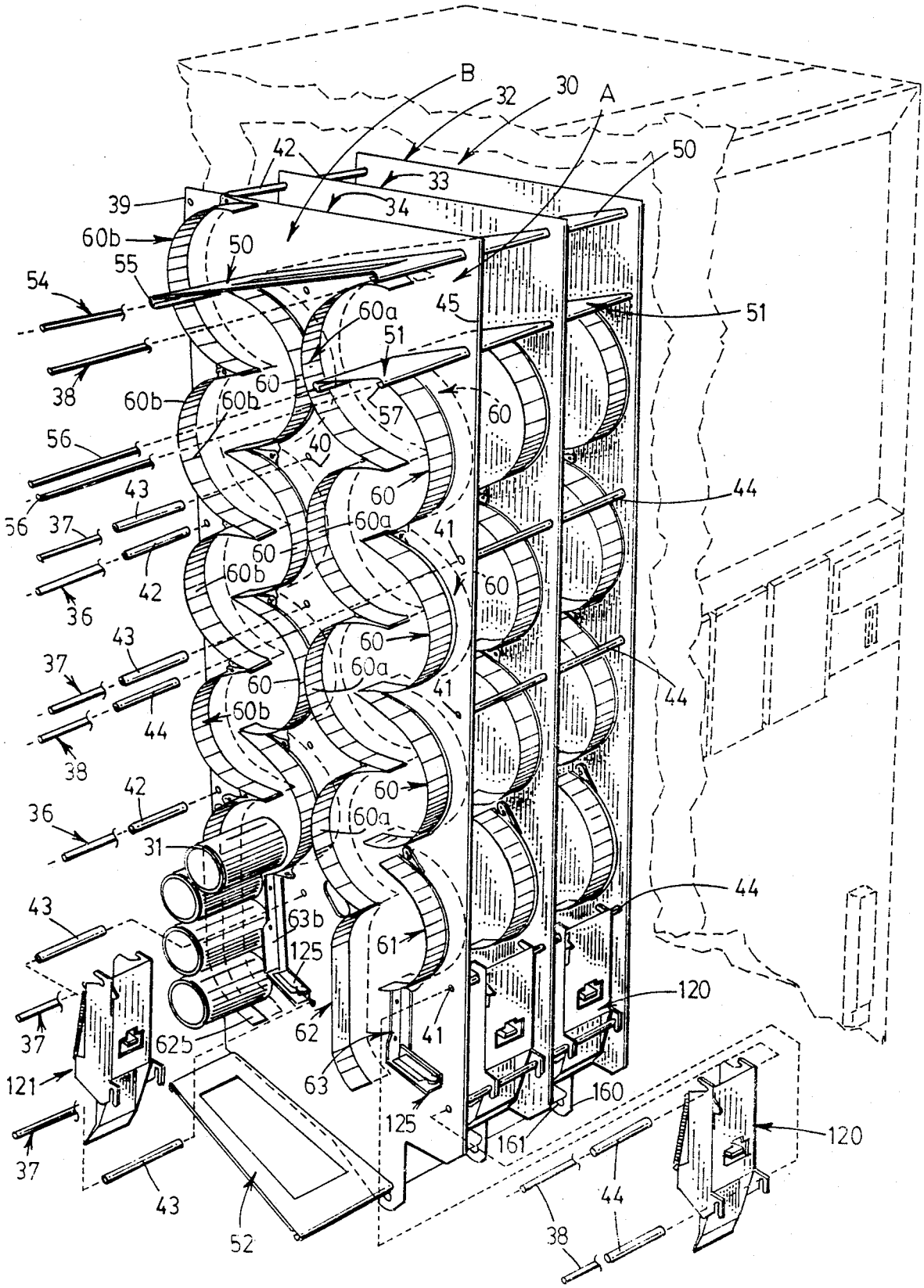
FIG. 2 is an enlarged partial perspective of a dual serpentine track magazine in accordance with this invention.

Turning now to the features of the preferred embodiment of this invention illustrated in the drawings, particular reference is made to FIG. 1.

As there shown, a typical can vending machine comprises a generally rectangular parallelopiped cabinet 24 adapted for upright positioning on an underlying support or floor. The front wall of the cabinet comprises a front door 25 typically having a display panel 26, a plurality of item selection buttons 27, a coin receptor 28 and a delivery stage 29 by which selected articles are vended to the customer. The cabinet is provided with the usual control circuitry for effecting the counting and crediting of deposited coins and initiation of a vending cycle, all in accordance with known and familiar practice.

Figure 3:
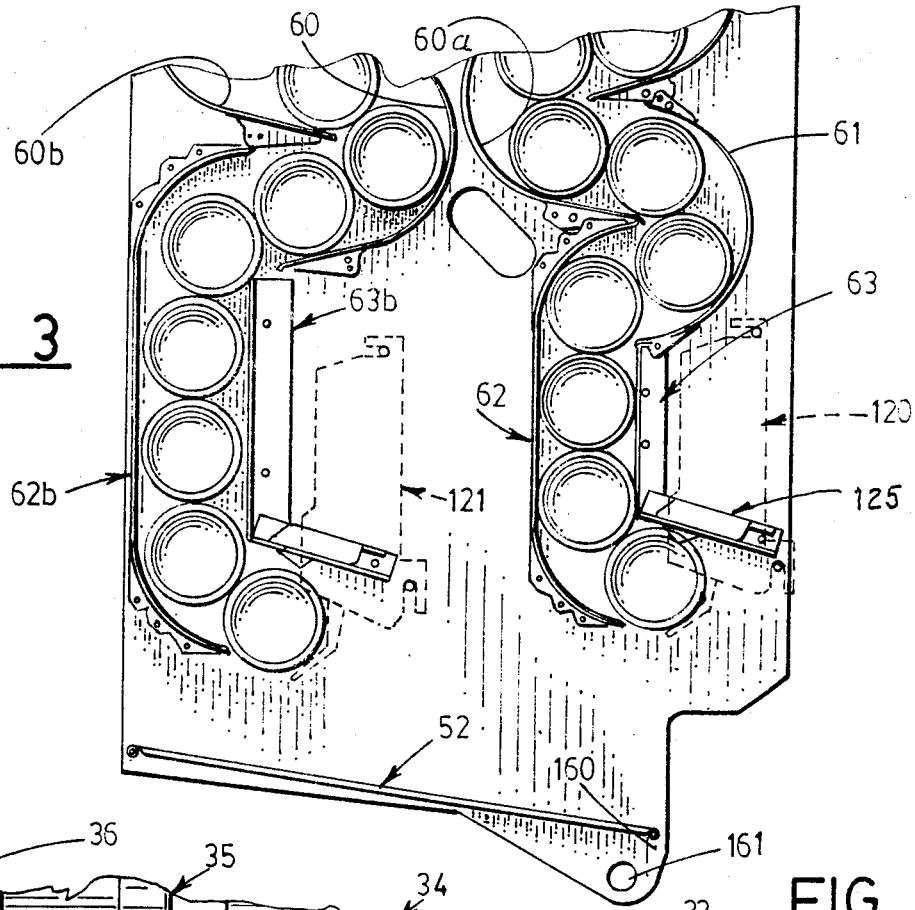
FIG. 3 is a partial side elevation of the magazine shown in FIG. 2.
Figure 4:
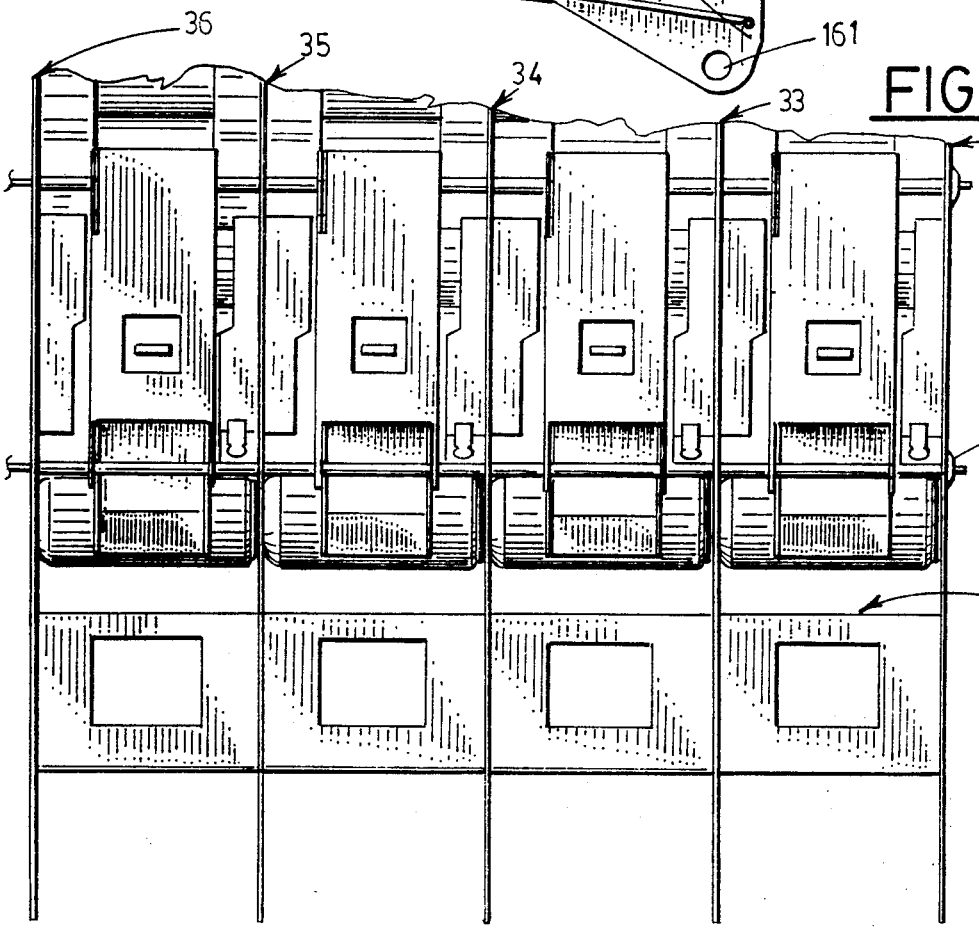
FIG. 4 is a partial front elevation thereof.

As illustrated in FIGS. 2–4 of the drawings, the interior of the cabinet 24 is equipped with a vertical multiple column magazine 30 capable of storing a plurality of cylindrical articles, such as canned beverages 31 for sale to the customer. As shown, the magazine 30 comprises a number of vertical columns open on the top, front and back sides and defined by and between laterally spaced parallel planar wall members, such as are indicated at 32–36. Such wall members and other elements of the magazine preferably are made of galvanized sheet steel. The walls are generally rectangular in profile as shown and are adapted to be mounted in an upright vertical operation position.

Each of the wall members 32–36, as well as additional like wall members required to define the desired number of columns for the magazine (typically six columns) is equipped with at least two front-to-back spaced, serpentine rail assemblies, labeled A and B in FIG. 2. In the case of the interior walls such as members 33 and 34, registeringly aligned and corresponding rail assemblies are formed on opposing planar faces thereof while the end walls 32, which mark the lateral limits of the magazine, are equipped with only one pair of the rail assemblies A and B (see FIG. 4). In this manner, with the several wall members 32, 33, 34, etc. assembled in their vertical upright position two pairs of the rail assemblies on opposing faces of adjacent walls, such as 33 and 34, formulate a pair of spaced serpentine tracks for storing the cylindrical articles 31 to be vended.

Proper location and lateral spacing of the several walls 32–34 is carried out principally by a series of elongated metal connector rods 36, 37 and 38 which pass transversely through holes 39, 40 and 41, respectively, formed in the wall members. Such connector rods carry larger diametered tubular spacer members 42, 43 and 44, respectively, which are located between adjacent wall members to define the lateral spacing thereof. The connector rods 36–38 are provided with a head at one end and suitable end fasteners 46 to rigidify the magazine structure and hold the rods and spacers in position (see FIG. 4). It will be noted that the several connector rods are not necessarily uniformly spaced throughout the vertical dimensions of the magazine wall members.

In addition to the connector rods described, rigidity and spacing of the wall members also is provided by virtue of intervening planar members located in each magazine column, namely, an elongated loading platform 50 at the upper end of each column, a shorter loading platform 51 disposed in spaced relation beneath one end of loading platform 50 and a discharge platform or wall 52 located beneath the serpentine tracks at the lower end of each column of the magazine assembly. The upper elongated loading platform 50 and delivery platform 52 are identical in construction and are held in sloping positions between adjacent wall members of the magazine by virtue of the connector rods 54 which pass through tubular formed spacer ends 55 of such platform members and appropriately disposed openings (unnumbered) in the walls members. The shorter loading platforms 51 similarly is held in position to and between each pair of adjacent magazine wall members by elongated connector rods 56 which pass through the wall members and tubular spacer end portions 57 of such shorter platforms.

As previously noted each of the interior separating wall members of the magazine carry a pair of the serpentine rails assemblies A and B on each face thereof which cooperate with registeringly aligned rail assemblies of adjacently opposed wall members to provide pairs of front-to-back spaced serpentine tracks in the magazine columns. The end wall members 32 of the magazine, however, carry only one set of such rail assemblies A and B. Although, the two rail assemblies A and B are generally similar, there are some variations therein as will appear from the following descriptions of their several elements as shown in FIGS. 3–18 of the drawings.

Rail Assembly A

As illustrated in FIG. 2, each of the serpentine rail assemblies A is made up of ten major elements, although, this number will vary depending on the height of the magazine. For present purposes of illustration, in a vending machine magazine having twelve serpentine tracks fitted into a cabinet height of substantially 72", a width of 36¾", and a depth of 30", each of the serpentine rail assemblies A constitute ten major elements as noted on the basis of the above specified cabinet size and twelve selection vending capability comprising six vending columns each having two serpentine tracks, a total vend capacity of 366 standard 12 oz. cylindrical beverage cans are accommodated in a magazine 30 of the present invention.

The above referred to ten major elements of the illustrated serpentine rails assembly A comprise seven identical curvelinear rail sections 60, one foreshortened curvelinear section 61, one elongated combination curvelinear/straight section 62, and one linear section 63. These sections will now be described in detail with reference to FIGS. 2–20 of the drawings.

The primary elements of each of the serpentine rail assemblies constitute the symmetrical curvelinear sections 60 illustrated in FIGS. 5 and 6 of the drawings. As shown, sections 60 preferably are formed as by roll forming or stamping galvanized sheet metal to form a curvelinear body portion 70 formed at a uniform radius to approximate a half circle; the ends of which merge into divergent linear leg portions 71, 71 which extend integrally outwardly therefrom in substantially tangential attitude from the curve of portion 70. Molding such elements of suitable plastic is also contemplated. Formed integrally with each of the linear leg sections 71 is a laterally extending planar, generally triangular shaped mounting ear 72 having a fastener opening 73 near one end and a larger adjacent opening 74 used in locating element 60 in a fixture for assembly with one of the wall members, such as wall 34 of the FIG. 2 embodiment.

Formed integrally with the curvelinear wall portion 70 and the two co-planar ear portions 72 of element 60 is a reenforcing skirt portion 75 which borders one edge or wall portion 70 and extends radially outwardly therefrom. Such skirt portion abuts one face of a vertical wall member of the magazine in assembly. The skirt portion 75 serves to rigidify element 60 to maintain its desired shape.

It will be noted that the linear arm portions 71 of element 60 are turned outwardly at their outer ends, as at 76, for purposes of overlapping corresponding ends of adjacent elements 60 in assembly to avoid sharp corners which might cause jamming of articles in the serpentine tracks.

Turning now to the features of the single smaller curvelinear element 61 of rail assembly A illustrated in FIGS. 7 and 8 of the drawings, it will be recognized that such element is substantially similar to element 60. Briefly, the same comprises a semi-circular curvelinear wall portion 80, foreshortened linear arm portions 81, 81 extending integrally from the ends of the curvelinear wall portion, transverse mounting ear portions 82, 82 extending laterally outwardly from the arm portions 81 and formed with mounting openings 83 and pilot openings 84 therethrough. As in the first described element 60, an outwardly turned lip 85 extends radially outwardly of one edge of the curvelinear wall portion 80 to reinforce and rigidify element 61. The linear arm portions 81 have their outer ends turned outwardly at 86, to cooperate with an adjacent element 60.

In addition to the curvelinear rail elements 60 and 61 above described, the rail assembly A also includes a single combination curvelinear/straight element 62, as illustrated in FIGS. 9 and 10 of the drawings. As there shown, element 62 comprises a pair of quarter circle curvelinear wall portions 90, 90 disposed at the opposite ends of an intervening linear wall portion 91; wall portions 90 being formed at a substantially 3 inch radius as with the curvelinear elements 60, 61 described. The outer ends of the curvelinear wall portions are formed integrally with laterally outwardly extending co-planar mounting ear portions 92, each having a pair of spaced mounting openings 93, 93 formed therethrough and a single pilot opening 94. Integral with the mounting ear portions 92 and bordering the length of the linear portion 91 is an outwardly turned reinforcing lip portion 95. The extreme outer ends of the curvelinear wall portions 90 are turned outwardly as at 96 similar to that feature of the heretofore described curvelinear sections 60 and 61.

Rail assembly A also includes a single short linear rail section 63 as illustrated in FIGS. 11 and 12 of the drawings. As shown, element 63 comprises a formed right angle section having a planar wall portion 100 adapted to engage and guide beverage cans therepast in operation. Wall portion 100 is shown with an enlarged planar portion 101 at one end thereof and is integral with a right angularly extending mounting plate portion 102 comprising a substantially rectangular planar wall having four fastener openings 103 adjacent its ends and two intermediate larger locator openings 104 for locating element 63 on one face of a vertical wall member, such as wall 34, when assembling the elements of rail assembly A.

Having described the several elements which go to make up the serpentine rail assembly A, examination of FIG. 2 in particular will readily demonstrate that the assembled elements thereof comprise a pair of laterally spaced opposing serpentine rows of elements mounted to each face of the wall members, such as wall member 34. The two spaced rows of elements in assembly A form an open serpentine rail track therebetween.

To that end, the leading row of elements which is closest to the front side of the magazine 30, as viewed in FIGS. 2 and 3 of the drawings, comprises four of the major curvelinear rail elements 60 aligned in vertical adjacency, with the lowermost thereof contiguous to the single foreshortened or smaller curvelinear rail element 61 and arranged so that concave curves of such elements face rearwardly of the magazine.

The second row of elements of assembly A comprises four of the major curvelinear rail elements, labeled **60*a*, which are stacked in vertical alignment with the concave sides thereof facing the front of the magazine. It will be noted that the curvelinear rail elements 60*a* of the secondary row are symmetrically interarranged with the corresponding opposed elements 60 so that the outer ends 76 of linear portions 71, 71 of the elements 60 and 60*a* terminate near the centers of curvature of the opposing row elements, thus formulating therebetween a serpentine rail track of generally uniform width throughout its length. This relationship is best illustrated in FIG. 3 of the drawings from which it will be recognized, among other things that the divergently turned outer ends 76 of the elements 60, 60*a* in the two vertical arrays of row elements, overlap one another to provide blunted corners about which the cylindrical beverage cans may circulate under gravity without hanging up or jamming. From such figure it also will be noted that the lowermost element 60 of the primary row of elements nearest the front end of the magazine is joined to the foreshortened curvelinear element 61 while the lower end of the latter element overlies the upper end of the vertically disposed linear rail element 63** to complete the primary row of rail elements.

The second row of rail elements for assembly A as noted, has the curvelinear elements **60*a* thereof in vertically staggered relationship to the corresponding elements in the first row; the uppermost curvelinear element 60*a* of such second row overhanging the upper end of the opposing element 60 in the first row of elements. The lower end of the lowermost element 60*a* of the secondary row is joined with the combined linear and curvelinear element 62 in which wall 91 parallels wall 100 of the linear rail element 63. In this latter regard the space between the walls of elements 62 and 63 is the same as between the curvelinear elements 60 and 60*a*** to provide uniform rail spacing throughout the rail track.

In the assembly of the serpentine rails of assembly A with a vertical wall member of the magazine, is to be understood that the various elements 60, 60*a*, 61, 63 thereof are in registering position on opposite sides of the same wall member; the mounting ear portions of adjacent elements lying in overlapping relationship. In the illustrated embodiment fastener openings in the mounting ears are coaxially aligned so that a single connective member will simultaneously interjoin corresponding ends of registeringly aligned elements on opposite faces of an intervening wall member. For ease of assembly, an appropriate fixture (not shown) is engageable with the several locating openings or holes in the mounting ears of the rail elements and corresponding openings formed through the wall members on which the elements are to be mounted. Once the various elements of the rail assembly A, for example, are aligned and held in the fixture, appropriate fasteners, such as rivets or spot welds, may be utilized to secure the elements to an intervening wall member.

Rail Assembly B

Rail assembly B as best shown in FIGS. 2–4 of the drawings is for all intents and purposes substantially identical to rail assembly A, heretofore described, except that the serpentine rails thereof are made up of staggered identical full curvelinear elements 60, 60*b*; there being four such elements in each of the two rows which form the serpentine assembly B. Further it will be noted from FIGS. 2 and 3 in particular that the several curvelinear element 60, 60*b* of rail assembly B are not aligned horizontally opposite their counterparts in the track assembly A, but are vertically offset upwardly therefrom. Thus, the uppermost rail element 60 in the fourth or rearwardmost row or rail elements of assembly B, has its upper end attached substantially at the upper edge of wall member 34 as opposed to the lowered positioning of the uppermost element 60*a* in the rail assembly A. This spacing differential between the two rail assemblies accommodates the loading of cylindrical cans or articles over the top of the rail assembly A as will be described in greater detail hereinafter. Because of the offsetting of the rail assembly B, the combined curvelinear and straight rail section 62*b* and the linear rail section 63*b* thereof are both elongated over their counterpart elements 62 and 63 in the rail assembly A. Particulars of such modified elements are shown in FIGS. 13–16 of the drawings.

Specifically, the modified combination curvelinear and linear element 62*b*, illustrated in FIGS. 13 and 14, is identical in all respects to element 62 heretofore described and illustrated in FIGS. 9 and 10 except that the linear or straight rail portion 91*b* thereof is longer than the corresponding portion 91 of element 62.

In a similar fashion the modified element 63*b* of FIGS. 15 and 16 is identical in all respects to the corresponding element 63 of FIGS. 11 and 12 except that the overall length of element 63*b* is greater than that of the described element 63. The differential in lengths of these vertical rail elements 62, 63, 62*b* and 63*b* is designed to accommodate the vertical offset relationship of the front and back rail assemblies A and B so that articles or cans emitting from the lower ends of the two rail assemblies do so at substantially the same level of discharge. This relationship is best shown in FIG. 3 of the drawings.

In addition to the opposing pairs of rail assemblies A and B, each column space between adjacent wall members of the magazine assembly 30 includes the two loading platforms 50 and 51 and a discharge platform 52.

The details of the loading platform 50 are best illustrated in FIGS. 17 and 18 of the drawings as comprising a generally rectangular planar body 110 having a central rectangular opening 111 and outwardly folded lateral margins 112, 112. Opposite ends of the body portion 110 are reentrantly folded to formulate the tubular portions 55 receptive of the previously described connectors rods 54, 38 and 56 in the assembled magazine 30.

For all intents and purposes the discharge platform member 52 at the lower end of the rail assemblies A and B of each magazine column is identical to the elongated loading platform member 50 and so will not be described further herein. It will be noted from FIG. 2, however, that the loading platform 50 is mounted over the uppermost curvelinear members 60, 60*a* of the rail assembly A and slopes rearwardly downward therefrom to overly the upper end of the rearwardly facing row of curvelinear members 60 in the secondary rail assembly B. This permits front loading of canned or cylindrical articles into the serpentine track formed by opposing sets of rail assemblies between adjacent wall members of the magazine columns. Contrastingly, the discharge platform 52 is located beneath the lower ends of the serpentine tracks in each column and slopes downwardly toward the front of the magazine to receive cylindrical canned articles dropped thereon upon actuation of either of the solenoid actuated electromechanical vending mechanisms 120 and 121 as shown in FIG. 3.

The vending mechanisms 120 and 121 are removably supported on two cross connecting rod elements 37 and 38 of the magazine assembly and are constructed and operate substantially in accordance with the teachings set out in U.S. Pat. No. 3,613,945 issued Oct. 19, 1971, and assigned to the assignee of this application.

Loading of the serpentine tracks formulated by opposing adjacent serpentine rail assemblies A for each column is via the shorter loading platform 51, best illustrated in FIGS. 19 and 20 of the drawings. As there shown element 51 comprises a generally rectangular galvanized sheet metal member having a planar body portion 123 with its lateral margins turned downwardly to form a rigidifying borders 124. The opposite ends of the body portion 123 are reentrantly formed to form the tubular spacer portions 57, as heretofore described, and which cooperate with the connector rods 56 in the assembly of the magazine as previously noted. It is to be recognized that the loading platform 51 is considerably shorter than the large loading platform 50 and that the same is disposed over the top of the uppermost curvelinear element 60 in the first row of such elements for a pair of cooperating rail assemblies A. One end of the element 50 is located closely adjacent to the leading edges of the two wall members with which it is associated and the other end thereof terminates substantially at the inner ends of the curvelinear element 60 therebeneath. In this fashion, cylindrical articles may be loaded into the upper end of the serpentine track assemblies formulated by the opposing cooperating pairs of rail assemblies A for each of the columns with the discharge of such cylindrical articles being effected at the lower end of elements 62 thereon upon article releasing operation of an associated vending mechanism 120.

In addition to the dual serpentine tracks composed of cooperating pairs of opposed serpentine rail assemblies A and B for each column of the magazine assembly 30, each of the serpentine tracks incorporates a sold out switch (not shown) and a can stop mechanism indicated generally at 125 in FIG. 2 and shown more specifically in FIGS. 21 and 22 of the drawings.

As shown, stop mechanism 125 comprises an elongated metal mounting bracket having a planar base wall 126 and an integral mounting wall 127 related at right angles to and located along one edge of base wall 126. The base wall as best shown in FIG. 21, is distinguished by a generally elongated rectangular opening 128 which communicates at one end with a smaller rectangular opening 129 aligned symmetrically of the longitudinal axis of opening 128.

The merging ends of the two openings 128 and 129 form a pair of laterally spaced shoulders 130 which act as fulcrums for a pivotal stop member 135 fabricated from sheet metal to include a pair of parallel side walls 136, 137 and a transverse top wall 138. The side walls 136 and 137 are each distinguished by a medially disposed extended pivot ear portion 140 which is adapted to engage one of the fulcrum shoulders 130 in the manner illustrated in FIG. 22. Specifically inside edges 141 of the ear portions 140 intersect bottom edges 142 of the side walls 136 and 137 to provide apices which engage the spaced shoulders 130 to permit pivotal activity of the stop member 135 thereabout. More particularly, member 135 moves through opening 128 between an actuated position as illustrated in FIG. 22 and a retracted position as illustrated in the upside-down perspective view of FIG. 20. In order to effectuate the movement of the stop member 135 between its retracted and actuated positions and to maintain such stop member in a desired position, a tension spring member 150 is mounted between the base wall 126 and the outer nose end 151 of the stop member. One end of spring 150 is secured in an opening 152 formed in base wall 126 adjacent the closed end of the narrow opening 129. The opposite end of the spring member is similarly secured through an appropriate opening (not shown) formed through the top wall of the stop member.

It will be noted that the edges 141 of the extending ear portions for the stop member serve to under engage the base wall 126 of the mounting bracket when the stop member 135 is in its actuated position as illustrated in FIG. 22. Wall 137 also may have a stop lug (not shown) struck laterally outwardly thereof to engage the upper face of wall 126 to prevent member 135 from being pulled through opening 128 when in its FIG. 22 operating position. This serves to limit the pivotal activity in a counter-clockwise direction as illustrated in that figure and to maintain member 135 in its actuated position under the tension force of spring 150. Conversely when stop member 135 is returned to its retracted condition bottom edges 142 of the side walls engage the upper face of base wall 126 (see FIG. 21) where spring 150 holds the same.

To manipulate member 135 the top wall 138 thereof is extended past walls 136, 137 to provide a manually engageable tongue portion 153 which may be engaged by the operator to actuate the stop means. It will be noted that when the stop member is tilted upwardly to move about the base wall 126 of the mounting bracket, the nose end 151 thereof extends into the path of movement of the cylindrical articles or cans 31 progressing down the slope of the delivery ramp 52. This interfering position prevents movement of the cans past the stop member and effectively holds the weight of the over disposed cans in the serpentine track against the stop member 135. This permits removal of the vending mechanism 120 or 121, as the case may be, for purposes of inspection and repair and maintains the cans or cylindrical articles in their stored position within the magazine tracks.

In order to mount the magazine assembly 30 within the interior confines of the cabinet 24, the several magazine walls 32–36, etc. are each provided with a depending ear portion 160 at the lower end thereof which is distinguished by a relatively large reinforced open 161 (see FIG. 3). A cylindrical rod (not shown) passes through openings 162 and is removably fastened at its ends to the interior side walls of the cabinet to pivotally secure the magazine in an upright position within the cabinet's interior. This permits the magazine to be tilted forward for repair purposes, such as clearing jammed cans or articles in the various and several serpentine tracks thereof. Positioning of the magazine assembly 30 in its upright operating position within the cabinet's interior is readily accomplished by the operator where it is secured by a suitable latch arrangement, not shown herein.

Having described this invention it is believe that those familiar with the art will readily recognize and appreciate the novel advancement thereof over the prior art and understand that while the same has been described in association with a particular preferred embodiment illustrated in the accompanying drawings, such is susceptible to wide variation, modification and substitution of equivalents without necessarily departing from the spirit and scope of the described invention which is intended to be unlimited by the specifics of the foregoing description except as may appear in the following appended claims.

The embodiments of the invention in which an exclusive property or privilege is claimed are defined as follows:

1. In an automatic, coin controlled vending machine for dispensing cylindrical articles, a storage magazine for holding a plurality of such articles, comprising a plurality of operationally vertical, planar wall members; means for rigidly interjoining and spacing said wall members in parallel relation to form plural like dimensioned vertical columns therebetween; at least one pair of vertical, non-interferingly aligned, back-to-back separated serpentine tracks in each of said columns for storing a plurality of cylindrical articles therein and gravitationally feeding the same to a single vend mechanism at the lower ends thereof; each of said tracks comprising a pair of registeringly aligned laterally spaced like serpentine rail assemblies on opposingly adjacent said wall members of each column; each rail assembly comprising a plurality of identical, symmetrically formed, curvelinear rail sections, each having a substantially half circle curvelinear body portion, a pair of divergently related linear leg portions extending integrally from opposite ends of said body portion, and planar mounting portions extending transversely of one edge of said leg portions and adapted to be fastened in face-to-face contact with a said wall member.

2. The magazine of claim 1, wherein said rail sections of each rail assembly are mounted on a said wall member in laterally spaced vertical rows wherein the said rail sections of each row are vertically contiguous; said mounting portions of vertically adjacent rail sections overlapping and comprising co-planar lateral extensions of said leg portions; the outer ends of said leg portions adjacent rail sections being aligned in angular intersecting relationship; and fastening means for connecting said overlapping mounting portions to a said wall member.

3. The magazine of claim 2, wherein each of said wall members which separate adjacent columns carries a pair of said rail assemblies on opposite faces thereof; the rail assemblies on one face of said wall members being registeringly aligned with the rail assemblies on the other face thereof; the said fastening means serving to interconnect registeringly aligned overlapping mounting portions on both sides of said wall members.

4. The magazine of claim 1, wherein each of said rail sections if formed to fabricate said body portion at a uniform radius, and a skirt portion extending radially outwardly of one edge of said body portion and merging in co-planar relation with said mounting portions to rigidify said rail section and body portion.

5. The magazine of claim 1, wherein each of said rail assemblies comprises two vertical, laterally spaced independent rows of said rail sections which are mounted and arranged so that concave sides of said body portions thereof face one another in vertically offset alignment; the outer ends of said leg portions of the rail sections in each of said rows being positioned substantially at the centers of curvature of the body portions of the said rail sections in the other of said rows whereby to define a serpentine rail track therebetween of substantially uniform width throughout its length.

6. The magazine of claim 1, wherein said tracks are vertically offset with one of said tracks extending vertically above the upper end of the other of said tracks.

7. The magazine of claim 5, wherein each of said rail assemblies comprises a vertical linear rail section at the lower end of one of said rows, and a combined curvelinear/straight rail section at the lower end of the other of said rows; such sections being arranged for reception, passage and discharge of articles to an associated said vend mechanism.

8. The magazine of claim 1, characterized by said pair of serpentine tracks being arranged in each column so that the upper and lower ends thereof face in like direction toward the front of said magazine, a pair of parallel planar loading platforms inclined downwardly from the front of said magazine toward the back thereof and disposed so that each platform communicates with the upper end of only one of said tracks, and a single platform mounted beneath both said tracks and inclined downwardly toward the front of said magazine for receiving articles discharged by the vend mechanisms individually associated with said tracks.

9. The magazine of claim 8, and a stop mechanism adjacent the lower end of each of said tracks comprising a manually operable spring loaded lever pivotally moveable between limits and adapted, at one of its limits, to block passage of articles to an associated said vend mechanism.

10. In an automatic, coin operated vending machine for dispensing cylindrical articles, a storage magazine for holding a plurality of articles, comprising plural vertical wall members rigidly interconnected in registering parallelism to define a plurality of intervening like dimensional columns, open along their top, bottom and side margins, each of said columns having at least one track assembly therein for storing a plurality of cylindrical articles and gravitationally feeding said articles to a vend mechanism disposed at the lower end thereof, and a manually operable stop mechanism mounted adjacent said lower end in advance of said vend mechanism for selectively preventing passage of articles to said vend mechanism comprising, a mounting bracket attachable to a said wall member and having a planar base wall operatively projecting transversely of said wall member to which the bracket is attached; said base wall having an elongated opening distinguished by a narrowed portion at one end and a widened portion at its other end and defining a pair of laterally separated co-linear shoulders; an elongated stop member having a pair of laterally spaced walls, and medially disposed projections along one edge thereof defining pivot ears adapted to engage said shoulders; spring means for resiliently interjoining an outer end of said stop member and said base wall, said spring means being fastened to said stop member and base wall on opposite sides of said ears and said shoulders whereby said ears are resiliently held against said shoulders; said ears and spaced walls of said stop member being operatively engageable with opposite sides of said base wall to determine limits of movement of said stop member and said spring means serving to resiliently hold said stop member at its said limits of movement; and manually engageable means on said stop member for grasping the stop member to manipulate the same to and between its said limits of movement.

* * * * *

UNITED STATES PATENT AND TRADEMARK OFFICE

CERTIFICATE OF CORRECTION

PATENT NO. : 4,913,313

DATED : 4/3/90

INVENTOR(S) : DONALD C. ROCKOLA

It is certified that error appears in the above-identified patent and that said Letters Patent is hereby corrected as shown below:

Col. 11, line 13, "if", should be "is".

Signed and Sealed this

Fifteenth Day of October, 1991

*Attest:*

HARRY F. MANBECK, JR.

*Attesting Officer*

*Commissioner of Patents and Trademarks*